US011462347B2

(12) United States Patent
Hasegawa

(10) Patent No.: US 11,462,347 B2
(45) Date of Patent: Oct. 4, 2022

(54) COIL COMPONENT AND METHOD OF MANUFACTURING COIL COMPONENT

(71) Applicant: Murata Manufacturing Co., Ltd., Kyoto-fu (JP)

(72) Inventor: Shin Hasegawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1051 days.

(21) Appl. No.: 16/100,101

(22) Filed: Aug. 9, 2018

(65) Prior Publication Data

US 2018/0350501 A1 Dec. 6, 2018

Related U.S. Application Data

(63) Continuation of application No. PCT/JP2017/005010, filed on Feb. 10, 2017.

(30) Foreign Application Priority Data

Feb. 15, 2016 (JP) ..... JP2016-026150

(51) Int. Cl.
*H01F 27/28* (2006.01)
*H01F 17/06* (2006.01)
(Continued)

(52) U.S. Cl.
CPC ..... *H01F 17/06* (2013.01); *H01F 17/045* (2013.01); *H01F 27/2823* (2013.01); *H01F 27/2828* (2013.01); *H01F 27/2895* (2013.01); *H01F 27/292* (2013.01); *H01F 27/38* (2013.01); *H01F 41/08* (2013.01); *H01F 41/10* (2013.01); *H01F 2017/065* (2013.01)

(58) Field of Classification Search
USPC ..... 336/229
See application file for complete search history.

(56) References Cited

U.S. PATENT DOCUMENTS 5,543,773 A * 8/1996 Evans ..... H01F 27/2804 336/183
7,982,572 B2 * 7/2011 Schaffer ..... H01F 41/046 336/200

FOREIGN PATENT DOCUMENTS

JP S50-20152 U1 3/1975
JP 11-97249 A 4/1999
(Continued)

OTHER PUBLICATIONS

International Search Report issued in PCT/JP2017/005010; dated Apr. 4, 2017.
(Continued)

*Primary Examiner* — Ronald Hinson
(74) *Attorney, Agent, or Firm* — Studebaker & Brackett PC

(57) ABSTRACT

A coil component includes an annular core and a first coil and a second coil wound around the core. The first coil and the second coil include first wire members and second wire members. The second wire members have end surfaces and which are brought into contact with side surfaces of first and second joining portions at tips of the first wire members. The first wire members and the second wire members are joined to each other with welding portions between the side surfaces of the first and second joining portions at the tips of the first wire members and the end surfaces of the second wire members interposed therebetween.

7 Claims, 13 Drawing Sheets

(51) Int. Cl.

| | |
|---|---|
| ***H01F 27/38*** | (2006.01) |
| ***H01F 41/10*** | (2006.01) |
| ***H01F 41/08*** | (2006.01) |
| ***H01F 17/04*** | (2006.01) |
| ***H01F 27/29*** | (2006.01) |

(56) References Cited

FOREIGN PATENT DOCUMENTS

| | | | |
|---|---|---|---|
| JP | 2004-259944 | A | 9/2004 |
| JP | 2007-208122 | A | 8/2007 |
| JP | 2016-207941 | A | 12/2016 |

OTHER PUBLICATIONS

International Preliminary Report on Patentability and Written Opinion issued in PCT/JP2017/005010; dated Aug. 21, 2018.

* cited by examiner

COIL COMPONENT AND METHOD OF MANUFACTURING COIL COMPONENT

CROSS-REFERENCE TO RELATED APPLICATIONS

This application claims benefit of priority to International Patent Application No. PCT/JP2017/005010, filed Feb. 10, 2017, and to Japanese Patent Application No. 2016-026150, filed Feb. 15, 2016, the entire contents of each are incorporated herein by reference.

BACKGROUND

Technical Field

The present disclosure relates to a coil component and a method of manufacturing the coil component.

Background Art

A coil component includes an annular toroidal core and a winding (coil) wound around the toroidal core as described, for example, in Japanese Unexamined Patent Application Publication No. 11-97249).

SUMMARY

In a coil component in which a large current is required to flow through a winding, it is necessary to wind a thick wire around a toroidal core. Due to the thickness of the wire, a winding bulge occurs. The winding bulge becomes remarkable when using a wire having an outer dimension (diameter) of equal to or more than 1.5 mm. In the wound wire, the minimum radius at the inner side of the wire is about 2 times the thickness of the wire. For this reason, for example, in the case of using a wire having a diameter of 1.5 mm, the radius at the inner side of the wire is equal to or more than 3.0 mm. Thus, there is a problem in that the size of coil component becomes larger.

The present disclosure provides a coil component which allows a large current to flow therethrough while being reduced in size and a method of manufacturing the coil component.

A method of manufacturing a coil component according to an aspect of the disclosure includes a first step of arranging a plurality of first wire members around an annular core, a second step of arranging second wire members between the first wire members adjacent to each other in a circumferential direction of the core and bringing joining surfaces of the second wire members into contact with side surfaces of joining portions at tips of the first wire members, and a third step of forming a coil wound around the core by the first wire members and the second wire members by welding the side surfaces of the joining portions and the joining surfaces.

According to this configuration, since the coil is formed by alternately joining the first wire members and the second wire members, winding bulge due to the wires does not occur. Accordingly, it is possible to reduce the size of the coil component which is manufactured using the thick first wire members and second wire members so as to allow a large current to flow therethrough. As a result, it is possible to manufacture the coil component which is reduced in size and allows a large current to flow through the coil.

In the above method of manufacturing the coil component, it is preferable that the first wire members and the second wire members made of the same metal material be used, and in the third step, the first wire members and the second wire members be joined together by welding portions which are formed by melting the first wire members and the second wire members.

According to this configuration, the welding portions are made of the same metal material as that of each of the first wire members and the second wire members. Therefore, interfaces, which are easy to be generated in joining of different types of metals, are difficult to be generated between the welding portions and the first wire members and between the welding portions and the second wire members. Accordingly, it is possible to reduce a resistance value of the coil as compared with a case where the first wire members and the second wire members are joined together using a joining material such as solder, for example.

In the above method of manufacturing the coil component, it is preferable that the third step include forming the plurality of welding portions for joining the side surfaces of the plurality of joining portions and the plurality of joining surfaces by emission of laser light, and the plurality of welding portions be formed by the laser light emitted from the same direction. According to this configuration, since the plurality of welding portions are formed by emitting the laser light from the same direction, it is possible to perform the process of joining the first wire members and the second wire members together in a short time.

In the above method of manufacturing the coil component, it is preferable that in the second step, the second wire members be respectively fitted into between the first wire members adjacent to each other in the circumferential direction of the core to bring the joining surfaces of the second wire members into contact with the side surfaces of the joining portions at the tips of the first wire members. According to this configuration, since the joining surfaces of the second wire members are fitted with the side surfaces of the joining portions at the tips of the first wire members, gaps are difficult to be generated between the first wire members and the second wire members. Therefore, the joining areas of joint parts when the side surfaces of the joining portions at the tips of the first wire members and the joining surfaces of the second wire members are welded to each other are increased, and resistance values on the joint parts can be reduced. Note that in this specification, fitting refers to tight fitting into a certain form.

In the above method of manufacturing the coil component, it is preferable that the second wire members having the joining surfaces areas which are larger than average cross-sectional area of the second wire members be used. According to this configuration, the areas of the joining surfaces of the second wire members are larger than the average cross-sectional area of the second wire members. Therefore, it is possible to increase the contact areas between the side surfaces of the joining portions at the tips of the first wire members and the joining surfaces of the second wire members by the amounts. Accordingly, it is possible to reduce the resistance values in the joint parts between the first wire members and the second wire members. Note that in this specification, the average cross-sectional area is a value obtained by dividing a volume of a member by a current path (length).

In the above method of manufacturing the coil component, it is preferable that the first wire members having step portions formed in the tips of the first wire members be used, and in the second step, the second wire members be fitted into the first wire members so as to abut against the step portions. According to this configuration, since the second wire members are fitted into the first wire members in a state of being positioned by the step portions, it is possible to suppress positional deviation when the first wire members and the second wire members are joined together.

In the above method of manufacturing the coil component, it is preferable that the first wire members having the joining portions of cylindrical shapes be used, and the second wire members having the joining surfaces as recessed cylindrical surfaces which are provided on end portions of the second wire members and are fitted with the joining portions be used. In addition, in the above method of manufacturing the coil component, it is preferable that the first wire members having the joining portions of cylindrical shapes be used, and the second wire members having the joining surfaces as inner circumferential surfaces of through-holes which are provided in the second wire members and into which the joining portions are tightly fitted be used.

According to these configurations, even if the angles formed between the first wire members and the second wire members, that is, the positions of the second wire members around the axial lines of the joining portions of the first wire members are changed, the contact areas between the side surfaces of the joining portions and the joining surfaces are not changed or are slightly changed even when the contact areas are changed. Therefore, the degree of freedom in the arrangement of the first wire members and the second wire members is increased. Accordingly, even if there are variations in the positional relationship between the second wire members and the first wire members which are fitted with the second wire members, it is possible to suppress decrease in the contact areas due to such variations and eventually increase in the joint resistances between both of the wire members.

In the above method of manufacturing the coil component, it is preferable that wire members having rectangular cross sections be used as at least one of the first wire members and the second wire members. According to this configuration, for example, when the wire members are placed on, for example, a jig or when the wire members are placed at predetermined positions using a supply device, the postures of the wire members are difficult to be changed and thus it is easy to maintain the placed states.

A coil component according to another aspect of the disclosure includes an annular core, and a coil wound around the core, wherein the coil includes a plurality of first wire members and a plurality of second wire members, the second wire members have joining surfaces in contact with side surfaces of joining portions at tips of the first wire members, and the first wire members and the second wire members are joined together with welding portions between the side surfaces of the joining portions and the joining surfaces interposed therebetween. According to this configuration, since the coil is formed by alternately joining the first wire members and the second wire members, the winding bulge due to the wires does not occur. Accordingly, it is possible to reduce the size of the coil component using the thick first wire members and second wire members so as to allow a large current to flow therethrough. As a result, the coil component allows a large current to flow through the coil while being reduced in size.

In the above coil component, it is preferable that areas of the joining surfaces be larger than the average cross-sectional area of the second wire members. According to this configuration, the areas of the joining surfaces of the second wire members are larger than the average cross-sectional area of the second wire members. Therefore, it is possible to increase the contact areas between the side surfaces of the joining portions at the tips of the first wire members and the joining surfaces of the second wire members by the amounts. Accordingly, it is possible to reduce the resistance values in the joint parts between the first wire members and the second wire members.

In the above coil component, it is preferable that the first wire members, the second wire members, and the welding portions be made of the same metal material. According to this configuration, the welding portions are made of the same metal material as that of each of the first wire members and the second wire members. Therefore, interfaces, which are easy to be generated in joining of different types of metals, are difficult to be generated between the welding portions and the first wire members and between the welding portions and the second wire members. Accordingly, it is possible to reduce the resistance value of the coil as compared with a case where the first wire members and the second wire members are joined together using a joining material such as solder, for example.

In the above coil component, it is preferable that the joining portions have cylindrical shapes and the joining surfaces be recessed cylindrical surfaces which are provided in end portions of the second wire members and are fitted with the joining portions. In addition, in the above coil component, it is preferable that the joining portions have cylindrical shapes, and the joining surfaces be inner circumferential surfaces of through-holes which are provided in end portions of the second wire members and into which the joining portions are tightly fitted.

According to these configurations, even if the angles formed between the first wire members and the second wire members, that is, the positions of the second wire members around the axial lines of the joining portions of the first wire members are changed, the contact areas between the side surfaces of the joining portions and the joining surfaces are not changed or are slightly changed even when the contact areas are changed. Therefore, the degree of freedom in the arrangement of the first wire members and the second wire members is increased. Accordingly, even if there are variations in the positional relationship between the second wire members and the first wire members which are fitted with the second wire members, it is possible to suppress decrease in the contact areas due to such variations and eventually increase in the joint resistances between both of the wire members.

In the above coil component, it is preferable that at least one of the first wire members and the second wire members have square cross sections. According to this configuration, it is possible to reduce the resistance values of the wire members having the square cross sections as compared with a case of using wire members having the same outer dimensions and circular cross sections. In addition, as compared with a case of using wire members having the same cross-sectional areas and the circular cross sections, the outer dimensions become smaller and the size of the coil can be reduced.

In the above coil component, it is preferable that at least one of the first wire members and the second wire members have circular cross sections. In general, the wire members having the circular cross sections are preferably used in order to reduce the cost of the coil component because the wire members having the circular cross sections are more inexpensive than wire members having rectangular cross sections.

According to the coil component and the method of manufacturing the coil component in the disclosure, a large current can be made to flow through the coil component while the coil component is made small in size.

DETAILED DESCRIPTION

Hereinafter, respective modes will be described. It should be noted that the accompanying drawings illustrate components in an enlarged manner for facilitating understanding. Dimensional ratios of the components may be different from actual ratios or ratios in different drawings.

First Embodiment

Hereinafter, a first embodiment will be described.

Figure 1:
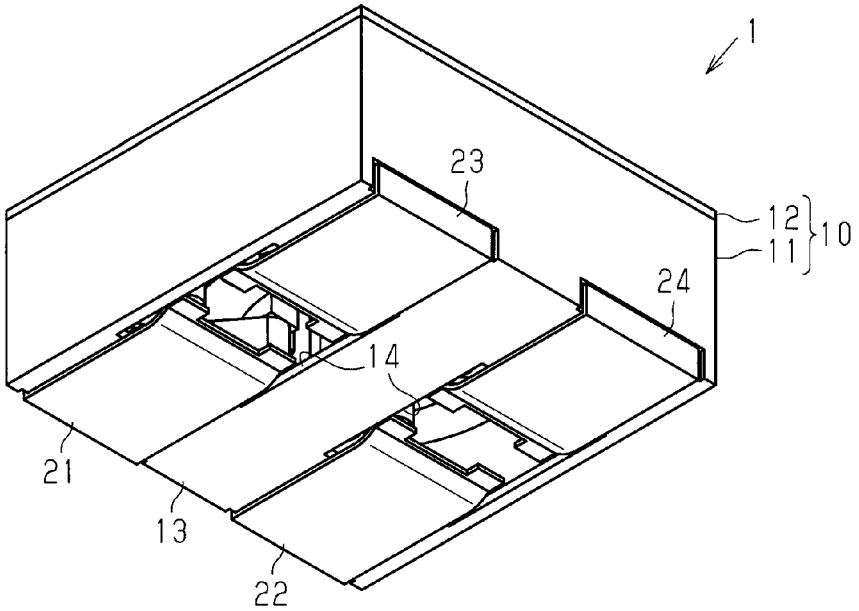
FIG. 1 is a perspective view showing a first embodiment of a coil component.
Figure 2:
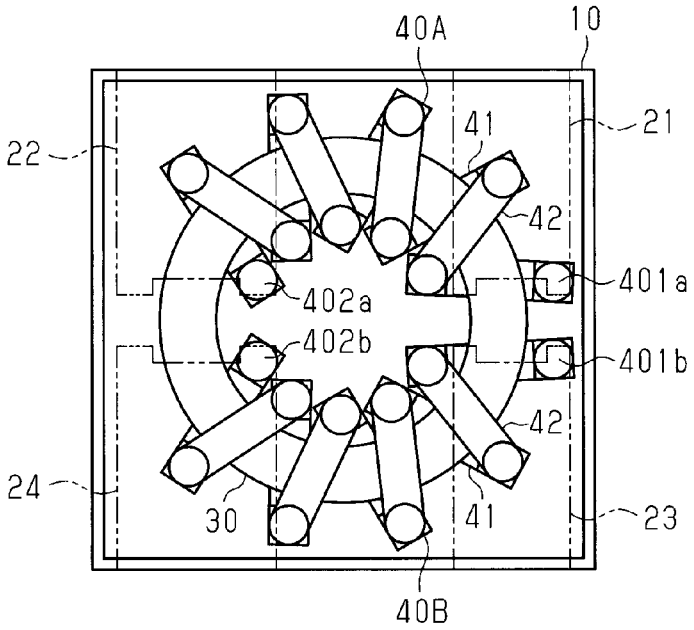
FIG. 2 is a schematic bottom view showing the first embodiment of the coil component.

As shown in FIG. 1 and FIG. 2, a coil component 1 includes a core 30, a first coil 40A, a second coil 40B, a rectangular parallelepiped case 10, and first to fourth electrode terminals 21 to 24 attached to the case 10. The case 10 has a box body 11 having an opening and a lid body 12 attached to the opening of the box body 11. The case 10 is made of, for example, resin such as polyphenylene sulfide resin or ceramics.

The first to fourth electrode terminals 21 to 24 are attached to the lower surface of a bottom portion 13 of the box body 11. The first to fourth electrode terminals 21 to 24 are formed by plate members and have shapes bent from the lower surface of the bottom portion 13 toward the side surfaces. The first to fourth electrode terminals 21 to 24 are disposed at four corners of the bottom portion 13. Further, the bottom portion 13 has a pair of openings 14 which are adjacent to each other with a central portion thereof interposed therebetween. Parts of the first to fourth electrode terminals 21 to 24 are exposed to the inside of the box body 11 through the pair of openings 14.

As shown in FIG. 2, the core 30, the first coil 40A, and the second coil 40B are accommodated in the case 10. FIG. 2 is a view of the case 10 as viewed from the lower surface side of the bottom portion 13 of the box body 11, and the first to fourth electrode terminals 21 to 24 are indicated by two-dot chain lines.

Figure 3:
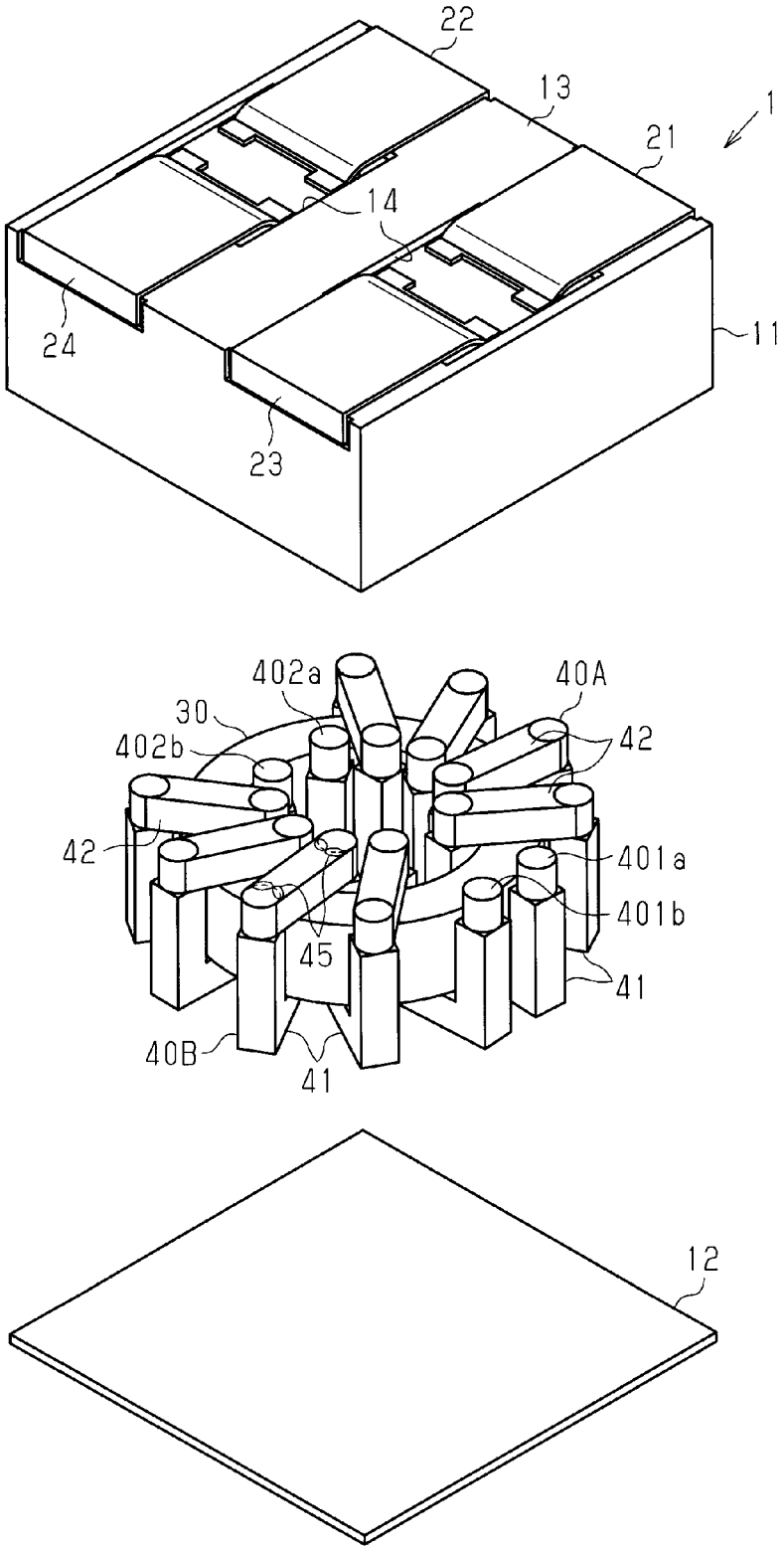
FIG. 3 is an exploded perspective view showing the first embodiment of the coil component.

As shown in FIG. 3, the core 30 is, for example, an annular magnetic core (toroidal core) having an annular shape. The surface (also referred to as a longitudinal cross section) of the core 30 cut in a plane perpendicular to the circumferential direction of the core 30 has a rectangular shape.

Figure 4A:
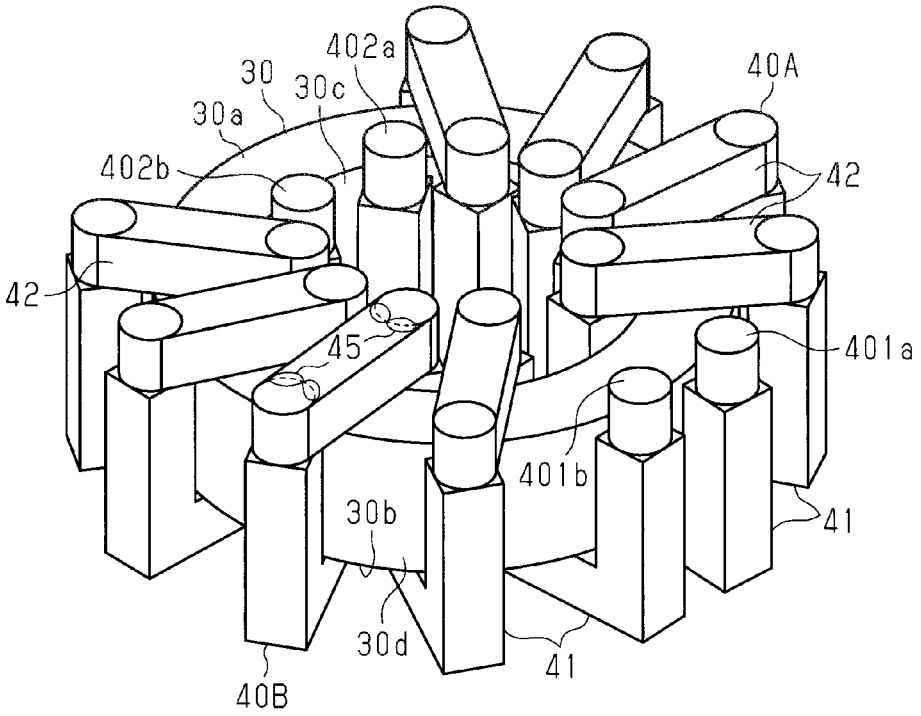
FIG. 4A is a perspective view showing a core and first and second wire members.

As shown in FIG. 4A, the core 30 has a first end surface 30*a* and a second end surface 30*b* that have a front-rear relationship in the axial direction. Further, the core 30 has an inner side surface 30*c* at the inner side in the radial direction and an outer side surface 30*d* at the outer side in the radial direction. The first end surface 30*a* of the core 30 faces the bottom portion 13 of the box body 11 shown in FIG. 3. The second end surface 30*b* of the core 30 faces the lid body 12 shown in FIG. 3.

The core 30 is made of, for example, a metal-based material such as soft ferrite and iron or a metal magnetic material. When the metal-based material is used, it is preferable to form an insulating film by sticking an insulating sheet on the surface or applying an insulating agent thereto.

The first coil 40A and the second coil 40B are wound around the core 30. As shown in FIG. 2, a first end portion 401*a* of the first coil 40A is electrically connected to the part of the first electrode terminal 21, which is exposed to the inside of the box body 11 through the opening 14 thereof. Similarly, a second end portion 402*a* of the first coil 40A is electrically connected to the second electrode terminal 22. A first end portion 401*b* of the second coil 40B is electrically connected to the third electrode terminal 23 and a second end portion 402*b* of the second coil 40B is electrically connected to the fourth electrode terminal 24.

The winding direction of the first coil 40A around the core 30 is opposite to the winding direction of the second coil 40B around the core 30. The number of turns of the first coil 40A is equal to that of the second coil 40B. The first coil 40A and the second coil 40B are used as, for example, a primary coil, a secondary coil, and a common mode choke coil.

The first coil 40A and the second coil 40B will now be described. As shown in FIG. 4A, the first coil 40A and the second coil 40B include a plurality of first wire members 41 and a plurality of second wire members 42. The plurality of first and second wire members 41 and 42 are joined together. The first and second wire members 41 and 42 are alternately joined together. In other words, in the pair of first wire members 41 and 41 adjacent to each other in the circumferential direction of the core 30, an end portion of one first wire member 41 in an outer side portion in the radial direction of the core 30 is connected to one end portion of the second wire member 42, and the other end portion of the second wire member 42 is connected to an end portion of the other wire member 41 in an inner side portion in the radial direction of the core 30. By repeating this joint, the first coil 40A and the second coil 40B are spirally wound around the core 30.

The first wire members 41 and the second wire members 42 have different shapes. The first wire members 41 are substantially U-shaped wires. The second wire members 42 are substantially linear wires. Here, the "substantially U shape" includes a U shape, a semicircular shape, and the like. The substantially linear shape includes a linear shape or a shape having a slight bend or curve. With these shapes, a unit element of one turn is formed by one first wire member 41 and one second wire member 42.

The first wire members 41 are arranged so as to surround the inner side surface 30*c*, the outer side surface 30*d*, and the second end surface 30*b* of the core 30. The second wire members 42 are arranged so as to face the first end surface 30*a* of the core 30. Further, the second wire members 42 are arranged between the tips of the two adjacent first wire members 41. The first and second wire members 41 and 42 are aligned along the circumferential direction of the first coil 40A and the second coil 40B.

The first wire members 41 adjacent to each other in the circumferential direction of the core 30 are spaced apart from each other. Similarly, the second wire members 42 adjacent to each other in the circumferential direction of the core 30 are spaced apart from each other. Thus, unlike a case where gaps between the first wire members 41 and between the second wire members 42 are filled with a filling material such as resin, it is possible to reduce stress on the core 30 by the filling material to reduce magnetostriction.

When the first and second wire members 41 and 42 are covered with the insulating film, the gaps between the first wire members 41 and between the second wire members 42 may be filled with a dielectric material. The dielectric material is, for example, resin containing a metal filler (such as copper (Cu) or silver (Ag)). Thus, it is possible to prevent decrease in magnetic force due to the dielectric material.

The first and second wire members 41 and 42 are made of, for example, a conductive material such as pure copper (Cu). Note that for the first and second wire members 41 and 42, a commonly-employed metal material, for example, gold (Au), silver (Ag), or aluminum (Al) may be used. Alternatively, a material obtained by plating copper (Cu) with nickel (Ni) or the like may be used.

The first and second wire members 41 and 42 are joined together by welding.

In this embodiment, welding portions 45 formed by melting the first and second wire members 41 and 42 are formed between the members. In FIG. 3 and FIG. 4A, some welding portions 45 of the first and second wire members 41 and 42 are shown and the others are omitted to show the shapes of the wire members.

The welding portions 45 are formed by, for example, laser beam welding. For example, a YAG laser, a fiber laser, or the like is used for the laser beam welding. By partially melting the first wire members 41 and the second wire members 42 by emitting the laser light thereto, the first wire members 41 and the second wire members 42 are joined together. The first wire members 41 and the second wire members 42 thus joined together and the welding portions 45 thereof contain only the material of the first wire members 41 and the second wire members 42, and do not contain a joining material such as solder. In other words, the first wire members 41 and the second wire members 42 are joined together to form the first coil 40A and the second coil 40B. When the two wire members are joined together using the joining material, the joining material creates two interfaces with different materials between the two wire members. The resistance values of the coils composed of the two wire members and the joining material are increased due to the presence of the interfaces.

On the other hand, as described above, the first coil 40A in the embodiment includes the first wire members 41 and the second wire members 42 and does not include the joining material. Therefore, the resistance value of the first coil 40A is smaller than that of the coil using the joining material. The second coil 40B is also similar to the first coil 40A. Accordingly, the first wire members 41 and the second wire members 42 are melted by the laser beam welding and joined together to form the first coil 40A and the second coil 40B, thereby suppressing increase in the resistance value.

Figure 4B:
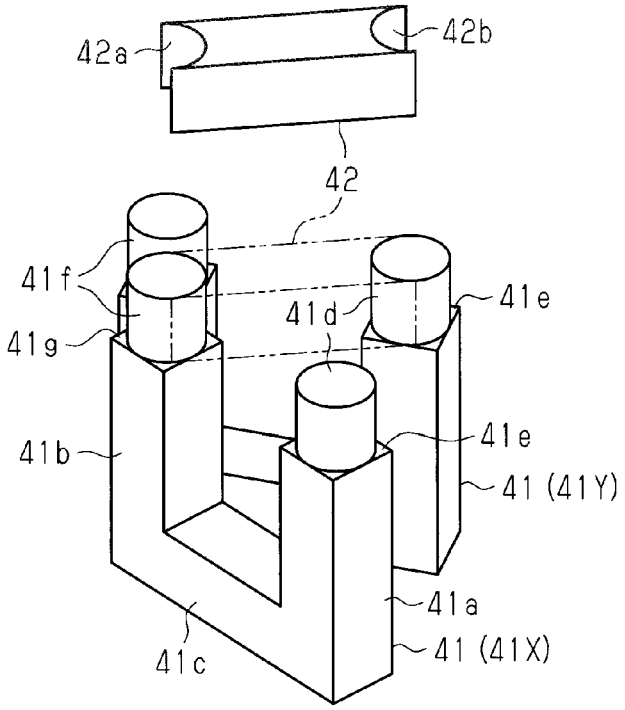
FIG. 4B is an enlarged perspective view of the first and second wire members.

The first wire members 41 and the second wire members 42 will now be described in detail. FIG. 4B shows two adjacent first wire members 41 and 41 and one second wire member 42 to be connected therebetween. Note that in FIG. 4B, when the two first wire members 41 and 41 are distinguished from each other, they will be described as first wire members 41X and 41Y.

Each first wire member 41 has first and second columnar portions 41*a* and 41*b* and a connecting portion 41*c* which connects one ends (base ends) of the first and second columnar portions 41*a* and 41*b* to each other. The first and second columnar portions 41*a* and 41*b* and the connecting portion 41*c* have square cross sections and are formed substantially linearly. The outer dimensions of the first and second columnar portions 41*a* and 41*b* and the connecting portion 41*c*, i.e., the thicknesses (the lengths of one sides of the cross sections) thereof are, for example, 1.5 mm.

A first joining portion 41*d* is formed at the tip of the first columnar portion 41*a*. The first joining portion 41*d* is formed in a cylindrical shape. For example, the outer dimension of the first joining portion 41*d*, i.e., the diameter thereof is, for example, 1.5 mm, and is equal to the thickness of the first columnar portion 41*a*. As described above, by forming the first joining portion 41*d* in the cylindrical shape for the prismatic first columnar portion 41*a*, the four corners of the first columnar portion 41*a* protrude outward relative to the side surface of the first joining portion 41*d* when viewed from the tip side, that is, from the side of the first joining portion 41*d*. These protruding portions are referred to as a step portion 41*e*. Similarly to the first columnar portion 41*a*, a second joining portion 41*f* is formed at the tip of the second columnar portion 41*b*. In addition, four corner portions of the second columnar portion 41*b*, which protrude outward relative to the side surface of the second joining portion 41*f* when viewed from the tip side, that is, from the side of the second joining portion 41*f* are referred to as a step portion 41*g*.

The first columnar portion 41*a* is disposed in an outer side portion in the radial direction of the core 30 shown in FIG. 4A, and the second columnar portion 41*b* is arranged in an inner side portion in the radial direction of the core 30. Accordingly, the first columnar portion 41*a* and the second columnar portion 41*b* are arranged with the core 30 interposed therebetween. The first columnar portion 41*a* and the second columnar portion 41*b* are arranged so as to extend along the central axis of the core 30. The connecting portion 41*c* is arranged at the side of the second end surface 30*b* of the core 30. The first joining portion 41*d* at the tip of the first columnar portion 41*a* and the second joining portion 41*f* at the tip of the second columnar portion 41*b* project to the side of the first end surface 30*a* of the core 30.

The second wire member 42 has a square cross section. The thickness of the second wire member 42 is equal to the heights of the first and second joining portions 41*d* and 41*f* of the first wire member 41, and is, for example, 1.5 mm. As shown by two-dot chain lines in FIG. 4B, the second wire member 42 is arranged between the tips of the first wire members 41X and 41Y arranged adjacent to each other.

The first joining portions 41*d* formed at the tips of the first wire members 41X and 41Y are arranged in the outer side portions in the radial direction of the core 30 shown in FIG. 4A, and the second joining portions 41*f* formed at the tips of the first wire members 41X and 41Y are arranged in the inner side portions in the radial direction of the core 30. The second wire member 42 is arranged between the second joining portion 41*f* formed at the tip of the second columnar portion 41*b* of the first wire member 41X and the first joining portion 41*d* formed at the tip of the first columnar portion 41*a* of the first wire member 41Y in the adjacently arranged first wire members 41X and 41Y.

An end surface 42*a* of the second wire member 42 abuts against the side surface of the second joining portion 41*f* of the first wire member 41X. The end surface 42*a* serves as a joining surface which joins the second wire member 42 to the side surface of the second joining portion 41*f* of the first wire member 41. An end surface 42*b* of the second wire member 42 abuts against the side surface of the first joining portion 41*d* of the first wire member 41Y. The end surface 42*b* serves as a joining surface which joins the second wire member 42 to the side surface of the first joining portion 41*d* of the first wire member 41. The end surfaces 42*a* and 42*b* of the second wire member 42 are formed so as to have areas larger than an average cross-sectional area of the second wire member 42 (an average cross-sectional area of a cross section in a quadrangular columnar portion). The average cross-sectional area is a value obtained by dividing the volume of the member by a current path (length).

Further, the end surfaces 42*a* and 42*b* of the second wire member 42 and the side surfaces of the first and second joining portions 41*d* and 41*f* of the first wire members 41 (41X and 41Y) are formed so as to be fitted with each other. In other words, the end surfaces 42*a* and 42*b* of the second wire member 42 are formed in shapes following the side surfaces of the first and second joining portions 41*d* and 41*f* of the first wire members 41 (41X and 41Y) (such that the shapes of the respective surfaces which are in contact with each other in fitting are the same). In this way, portions where the shapes of the two portions correspond to and make plane contact with each other are referred to as fitting parts. Such fitting parts facilitate the joining of the first wire members 41 and the second wire members 42.

Specifically, the end surfaces 42*a* and 42*b* of the second wire member 42 are recessed cylindrical surfaces that are fitted with the side surfaces of the first and second cylindrical joining portions 41*d* and 41*f* and have the same curvatures as those of the side surfaces. It should be noted that the length of each recessed cylindrical surface in the circumferential direction is equal to the length of the half circumference of each of the first and second joining portions 41*d* and 41*f*.

Figure 5A:
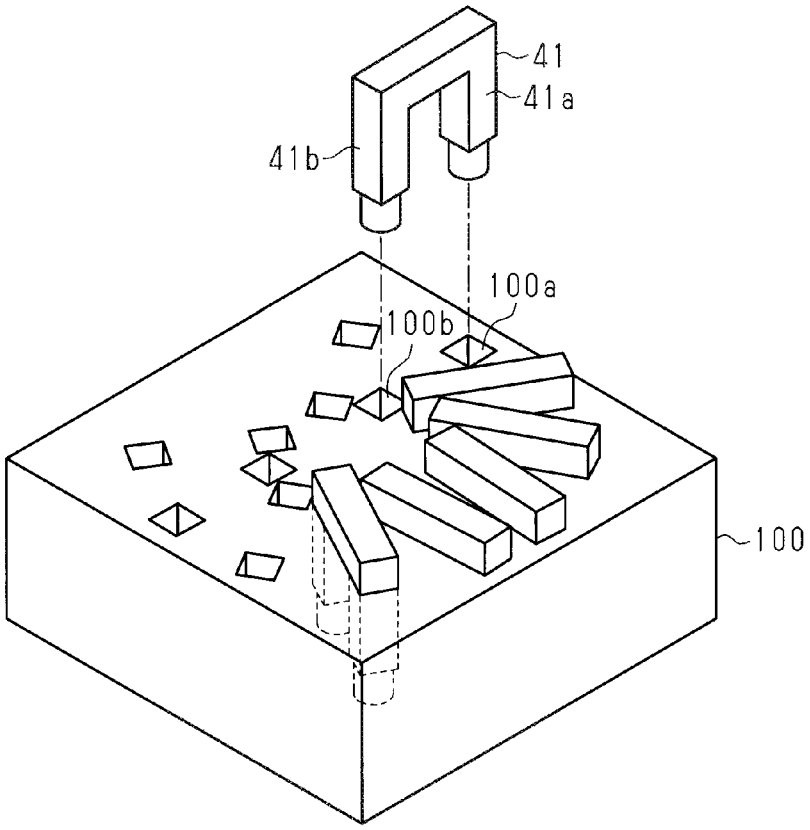
FIGS. 5A to 5C are descriptive views for explaining a method of manufacturing the coil component.

Next, a method of manufacturing the above-described coil component 1 will be described. As shown in FIG. 5A, the first wire members 41 are aligned using a jig 100. Each first wire member 41 is formed by bending a linear bar material having a square cross section and processing the tips thereof into cylindrical shapes. Each second wire member 42 is formed by processing end portions of a linear bar material having a square cross section into the recessed cylindrical end surfaces 42*a* and 42*b*. Insertion holes 100*a* and 100*b* for inserting the first and second columnar portions 41*a* and 41*b* of the first wire members 41 thereinto are formed in the jig 100.

Figure 5B:
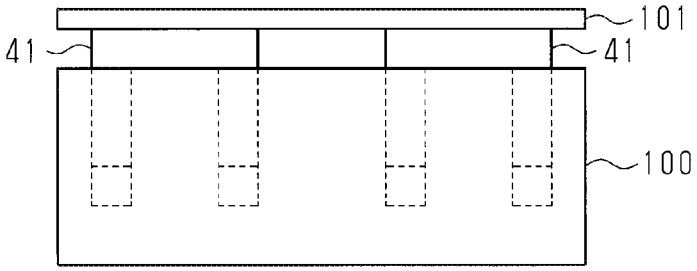

As shown in FIG. 5B, an adhesive jig 101 is attached to the first wire members 41 inserted into the jig 100. For example, the adhesive jig 101 is formed by applying an adhesive material to the surface of a resin film such as PET or the like. Note that a rubber sheet may be used as the adhesive jig 101.

Figure 5C:
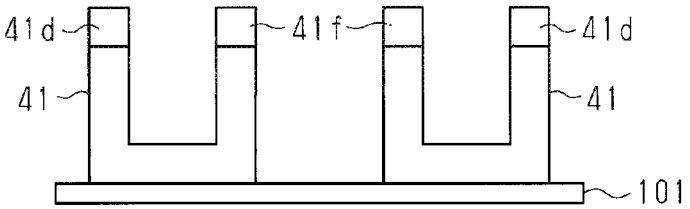

As shown in FIG. 5C, after detaching the first wire members 41 from the jig 100 (see FIG. 5B), they are arranged while the adhesive jig 101 is at the lower side. Thus, the plurality of first wire members 41 are temporarily fixed to the upper surface of the adhesive jig 101. At this time, the plurality of first wire members 41 are arranged such that the first and second joining portions 41*d* and 41*f* at the tips of the first wire members 41 face upward.

Figure 6A:
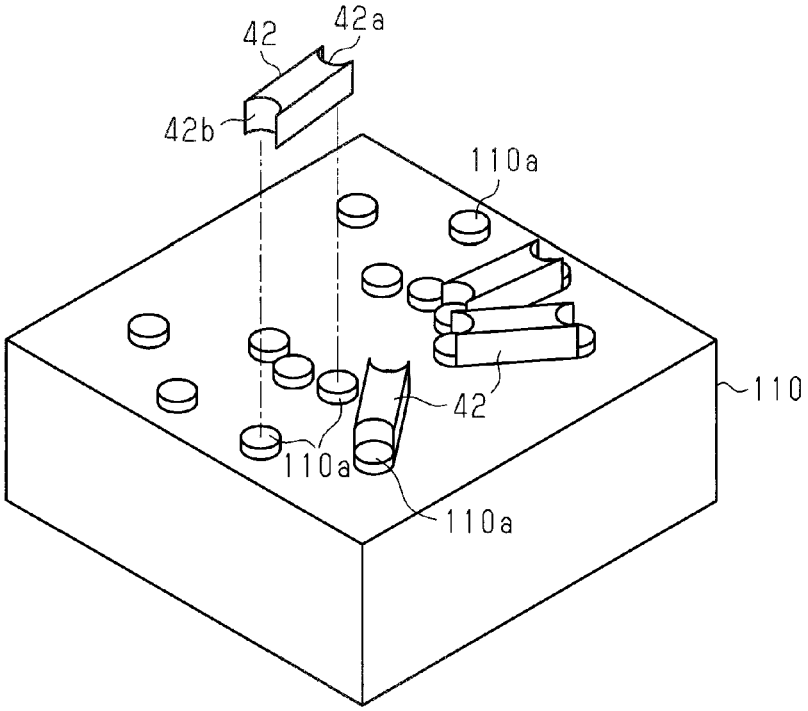
FIGS. 6A to 6C are descriptive views for explaining the method of manufacturing the coil component.

As shown in FIG. 6A, the second wire members 42 are aligned using a jig 110. Positioning projections 110*a* are formed on the upper surface of the jig 110. The second wire members 42 are placed on the upper surface of the jig 110 so as to correspond to these projections 110*a*. The second wire members 42 are formed in prismatic shapes (having square cross sections). Therefore, each of the second wire members 42 can be easily aligned such that axial lines of the end surfaces 42*a* and 42*b* which are the recessed cylindrical surfaces of the second wire member 42 (see dashed lines in FIG. 6A) are perpendicular to the upper surface of the jig 110. Further, since the second wire members 42 have the prismatic shapes, an aligned state is maintained.

Figure 6B:
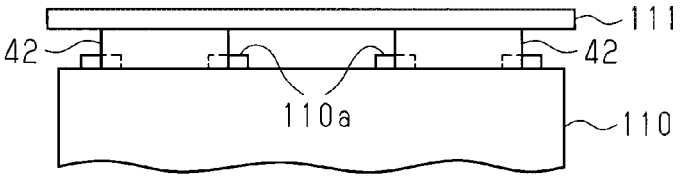

As shown in FIG. 6B, an adhesive jig 111 is made to adhere to the second wire members 42 aligned on the jig 110. For example, the adhesive jig 111 is formed by applying an adhesive material to the surface of a resin film such as PET or the like. Note that a rubber sheet may be used as the adhesive jig 111.

Figure 6C:
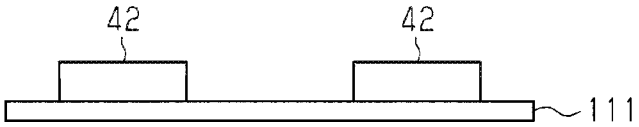

As shown in FIG. 6C, after detaching the second wire members 42 from the jig 110 (see FIG. 6B), they are arranged while the adhesive jig 111 is at the lower side. Thus, the plurality of second wire members 42 are temporarily fixed to the upper surface of the adhesive jig 111.

Figure 7:
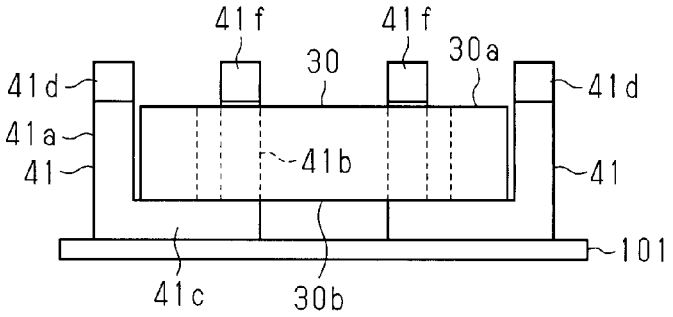
FIG. 7 is a descriptive view for explaining the method of manufacturing the coil component.

As shown in FIG. 7, the core 30 is inserted between the first and second columnar portions 41*a* and 41*b* of the plurality of first wire members 41 temporarily fixed to the upper surface of the adhesive jig 101. Through the above steps, the plurality of first wire members 41 are arranged around the core 30.

Figure 8:
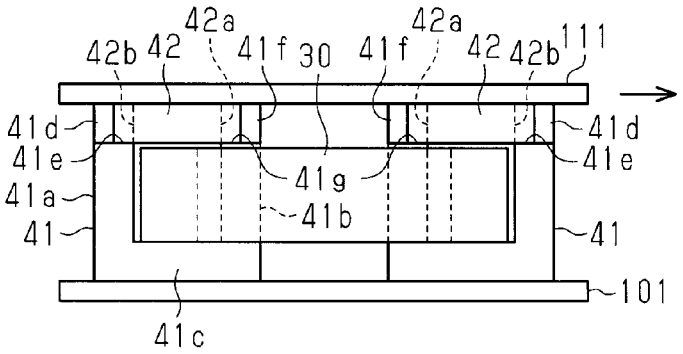
FIG. 8 is a descriptive view for explaining the method of manufacturing the coil component.

As shown in FIG. 8, the second wire members 42 temporarily fixed to the adhesive jig 111 are inserted between the first wire members 41, and the second wire members 42 are fitted into the first wire members 41. In other words, the side surfaces of the first and second joining portions 41*d* and 41*f* of the first wire members 41 are made to face the end surfaces 42*a* and 42*b* of the second wire members 42. Then, for example, as indicated by an arrow in FIG. 8, the adhesive jig 111 is moved in the horizontal direction. Since the second wire members 42 are inserted between the tips of the first wire members 41, only the adhesive jig 111 is moved and the second wire members 42 are detached from the adhesive jig 111. At this time, end portions of the second wire members 42 abut against the step portions 41*e* and 41*g* of the first wire members 41, and the second wire members 42 are positioned in a state of being fitted into the first wire members 41.

Figure 9:
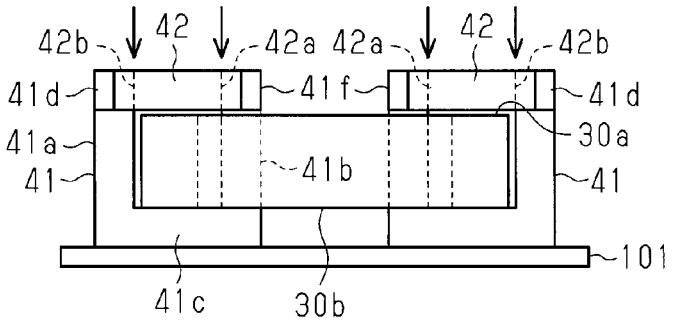
FIG. 9 is a descriptive view for explaining the method of manufacturing the coil component.

As shown in FIG. 9, laser light is emitted to the fitting parts of the first wire members 41 and the second wire members 42 from the same direction, specifically, from the upper side so as to be incident thereon in parallel with the axial lines of the first and second joining portions 41*d* and 41*f* of the first wire members 41. The side surfaces of the first and second joining portions 41*d* and 41*f* of the first wire members 41 are thereby welded to the end surfaces 42*a* and 42*b* of the second wire members 42. Arrows in FIG. 9 indicate emitting positions of the laser light. The emitting positions of the laser light are the fitting parts between the side surfaces of the first and second joining portions 41*d* and 41*f* of the first wire members 41 and the end surfaces 42*a* and 42*b* of the second wire members 42.

When a laser device having a large laser irradiation area (spot diameter) and a high peak irradiation energy is used as a device for emitting the laser light, for example, a YAG laser is used, the laser light is emitted to spots on the fitting parts. As the YAG laser, for example, a laser device having a peak energy of 7 kW, an irradiation time of 10 ms, an irradiation energy of 70 J, a spot diameter of 0.5 mm, and a power density of about 350 W/cm$^2$ can be used. The first wire members 41 and the second wire members are melted by the laser light, and the welding portions 45 shown in FIG. 3 and FIG. 4A are formed by hardening. Then, the first wire members 41 and the second wire members 42 are joined together to form the first coil 40A and the second coil 40B shown in FIG. 4A.

When a laser device having a small laser irradiation area (spot diameter) and a low peak irradiation energy is used as the device for emitting the laser light, for example, a fiber laser is used, the laser light is continuously emitted along the above-described fitting parts. As the fiber laser, for example, a laser device having a peak energy of 1 kW, an irradiation time of 200 ms, an irradiation energy of 200 J, a spot diameter of 0.04 mm, and a power density of about 8000 W/cm$^2$ can be used. In this case, the welding portions 45 are formed so as to extend along the first and second joining portions 41*d* and 41*f* of the first wire members 41 and the end surfaces 42*a* and 42*b* of the second wire members 42. As described above, since the irradiation positions of the laser light having the small irradiation area can be focused on, the irradiation positions can be controlled with high accuracy. Therefore, it is possible to reduce reflection and emission of the laser light to other portions.

In addition, since the fitting parts of the side surfaces of the first and second joining portions 41*d* and 41*f* of the first wire members 41 and the end surfaces 42*a* and 42*b* of the second wire members 42 are all exposed upward, the laser light can be emitted to the respective fitting parts in the same direction.

Figure 10:
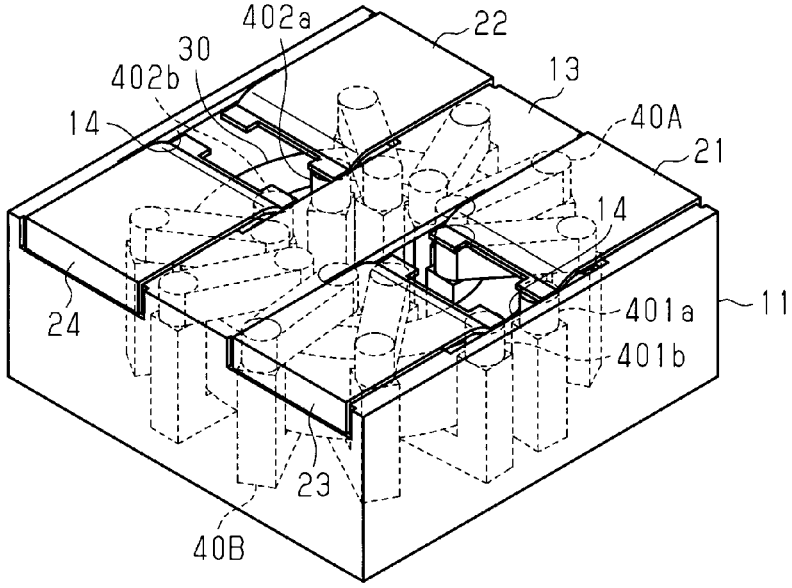
FIG. 10 is a descriptive view for explaining the method of manufacturing the coil component.

As shown in FIG. 10, the first coil 40A, the second coil 40B, and the core 30 are inserted into the box body 11 to which the first to fourth electrode terminals 21 to 24 have been attached. Then, the first coil 40A and the first and second electrode terminals 21 and 22 are electrically connected to each other, and the second coil 40B and the third and fourth electrode terminals 23 and 24 are electrically connected to each other. For example, by the laser beam welding, the first and second end portions 401*a*, 402*a*, 401*b*, and 402*b* of the first coil 40A and the second coil 40B are respectively welded to the first to fourth electrode terminals 21 to 24. Note that the first and second end portions 401*a*, 402*a*, 401*b*, and 402*b* of the first coil 40A and the second coil 40B may be respectively joined to the first to fourth electrode terminals 21 to 24 using the joining material such as solder.

Figure 11:
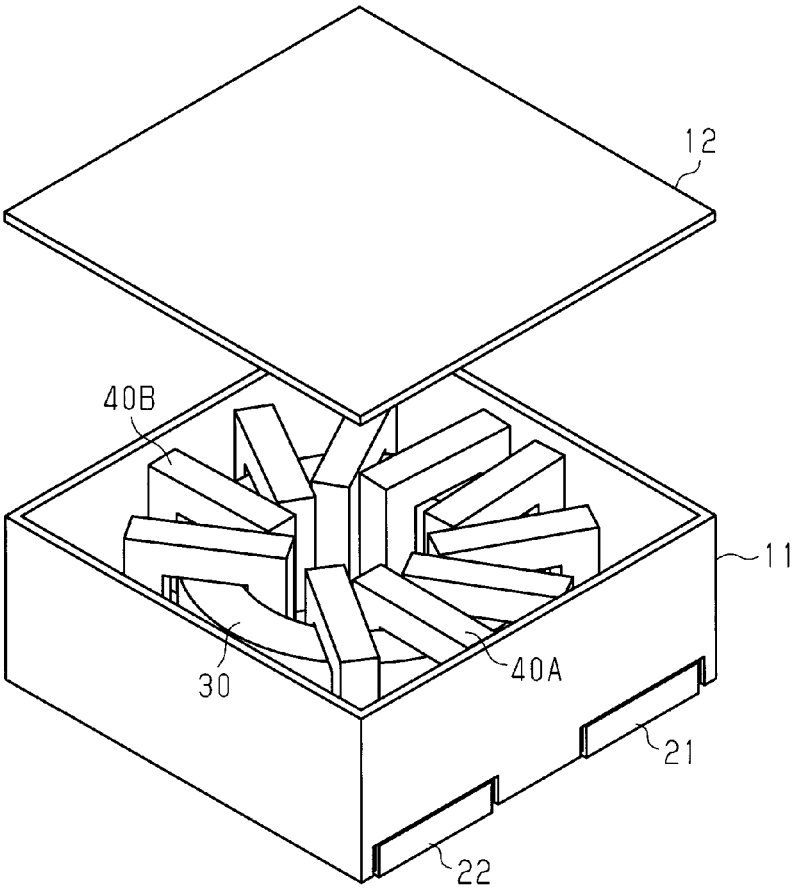
FIG. 11 is a descriptive view for explaining the method of manufacturing the coil component.

As shown in FIG. 11, the lid body 12 is attached to the opening of the box body 11. The lid body 12 is fixed to the box body 11 by, for example, an adhesive. Note that the lid body 12 may be fixed to the box body 11 by fitting.

As described above, according to the embodiment, the following operational effects can be obtained.

(1-1) Since the first coil 40A and the second coil 40B are formed by alternately joining the first wire members 41 and the second wire members 42 together, winding bulge due to the wires does not occur. Accordingly, it is possible to reduce the size of the coil component 1. Further, the end surfaces 42*a* and 42*b* of the second wire members 42 are fitted with the side surfaces of the first and second joining portions 41*d* and 41*f* at the tips of the first wire members 41. In other words, the side surfaces of the first and second joining portions 41*d* and 41*f* come into contact with the end surfaces 42*a* and 42*b* of the second wire members 42 with shapes that follow each other. Gaps are therefore difficult to be generated between the first wire members 41 and the second wire members 42. Therefore, when the side surfaces of the first and second joining portions 41*d* and 41*f* of the first wire members 41 and the end surfaces 42*a* and 42*b* of the second wire members 42 are joined together, heat of the laser light is easily transferred. Accordingly, it is possible to increase the joining areas of the joint parts, i.e., the cross sections of the welding portions 45. As a result, the resistance values on the joint parts become small, and a large current can be made to flow through the first coil 40A and the second coil 40B. Further, the resistance values are reduced and heat generation due to the current is suppressed, thereby increasing the amount of current flowing through the first coil 40A and the second coil 40B. For example, a coil component of a class 15 A can be changed to that of a class 20 A. In addition, since heat is easily transmitted, it is possible to join them in a short time with the laser light of constant output and a processing speed can be increased. On the other hand, preferable joint can be achieved even when laser light of low output is used.

(1-2) Since the areas of the end surfaces 42*a* and 42*b* of the second wire members 42 are larger than the average cross-sectional area of the second wire members 42, it is possible to increase the contact areas between the side surfaces of the first and second joining portions 41*d* and 41*f* at the tips of the first wire members 41 and the end surfaces 42*a* and 42*b* of the second wire members 42 by the amounts. Accordingly it is possible to reduce the resistance values in the joint parts between the first wire members 41 and the second wire members 42.

In the manufacturing process, compared with the case where the cross-sectional areas of the second wire members 42 are made equal to the average cross-sectional area, the welding areas of the welding portions 45 are easily made larger than the average cross-sectional area, and thus the joining strength at the joint parts is easily increased. When it is sufficient that minimum welding areas equal to the average cross-sectional area of the second wire members 42 can be ensured, it is possible to form the welding portions 45 without performing the positioning of a machine which is used for joining (for example, adjusting the irradiation positions of the laser light in the laser device) with high accuracy. Thus, it is possible to shorten a time required for the joining process.

(1-3) The welding portions 45 are made of the same metal material as the first wire members 41 and the second wire members 42. Therefore, interfaces, which are easy to be generated in joining of different types of metals, are made difficult to be generated between the welding portions 45 and the first wire members 41 and between the welding portions 45 and the second wire members 42. Accordingly, it is possible to reduce the resistance values of the first coil 40A and the second coil 40B as compared with a case where the first wire members 41 and the second wire members 42 are joined together using the joining material such as solder, for example.

(1-4) The first and second joining portions 41*d* and 41*f* at the tips of the first wire members 41 have the cylindrical shapes, and the end surfaces 42*a* and 42*b* of the second wire members 42 are the recessed cylindrical surfaces having the curvatures equal to those of the first and second joining portions 41*d* and 41*f*. Accordingly, even if the angles formed between the first wire members 41 and the second wire members 42, that is, the positions of the second wire members 42 around the axial lines of the first and second joining portions 41*d* and 41*f* of the first wire members 41 are changed, the contact areas between the side surfaces of the first and second joining portions 41*d* and 41*f* and the end surfaces 42*a* and 42*b* of the second wire members 42 are not changed or are slightly changed even when the contact areas are changed. Therefore, the degree of freedom in the arrangement of the first and second wire members 41 and 42 is increased. Accordingly, even if there are variations in the positional relationship between the second wire members 42 and the first wire members 41 which are fitted with the second wire members 42, it is possible to suppress the increase in the joint resistances between both of the wire members 41 and 42 due to such variations. Further, during welding, positional deviation of the first wire members 41 and the second wire members 42 hardly occurs, so that occurrence of welding failure can be suppressed and a yield can be improved.

(1-5) The first wire members 41 and the second wire members 42 are the bar materials (square materials, square wires) having the square cross sections. Therefore, when the first and second wire members 41 and 42 are respectively placed on the jigs 100 and 110 and the adhesive jigs 101 and 111, the postures of the respective first and second wire members 41 and 42 are hard to be changed, and thus it is easy to maintain the placed states.

(1-6) Since the first and second wire members 41 and 42 have the square cross sections, it is possible to reduce the resistance values of the first and second wire members 41 and 42 as compared with a case of using wire members having the same outer dimensions and circular cross sections. Further, as compared with a case where wire members having the circular cross sections and the cross-sectional areas of which are equal to those of the first and the second wire members 41 and 42 are employed, the outer dimensions of the wire members are reduced and the sizes of the first coil 40A and the second coil 40B can be reduced.

(1-7) The fitting parts of the side surfaces of the first and second joining portions 41*d* and 41*f* of the first wire members 41 and the end surfaces 42*a* and 42*b* of the second wire members 42 are all exposed upward. Therefore, it is possible to emit the laser light to the plurality of fitting parts from the same direction, and it is not necessary to change the postures of the first wire members 41 and the second wire members 42 with respect to the laser device that emits the laser light, or the change amounts are small even if the postures are changed. Thus, the welding process can be completed in a short time. In addition, since the welding portions 45 can be seen from one direction, it is possible to easily check the welding portions 45 in which welding failure has occurred.

(1-8) Since the second wire members 42 are fitted into the first wire members 41 in a state of being positioned by the step portions 41*e* and 41*g* of the first wire members 41, positional deviation is unlikely to occur during welding, and a time taken for the welding process can be shortened.

(1-9) The heights of the first and second joining portions 41*d* and 41*f* of the first wire members 41 are equal to the thicknesses of the second wire members 42. Accordingly, the upper surfaces of the second wire members 42 positioned by the step portions 41*e* and 41*g* flush with the end surfaces (upper surfaces) of the first and second joining portions 41*d* and 41*f*. Thus, it is possible to easily control focusing of the laser light on both of the upper surfaces of the first and second joining portions 41*d* and 41*f* of the first wire member 41 and the upper surfaces of the second wire members 42.

Second Embodiment

Hereinafter, a second embodiment will be described.

In this embodiment, the same constituent members as those in the above-described first embodiment will be denoted by the same reference signs, and description thereof will be appropriately omitted. Further, description of relationships between the same constituent members will be also appropriately omitted.

Figure 12:
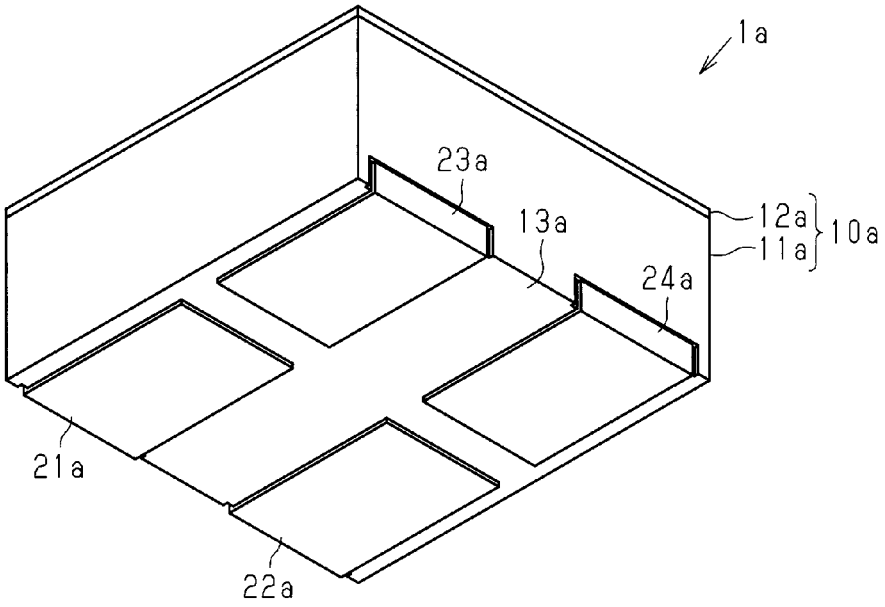
FIG. 12 is a perspective view showing a second embodiment of a coil component.
Figure 13:
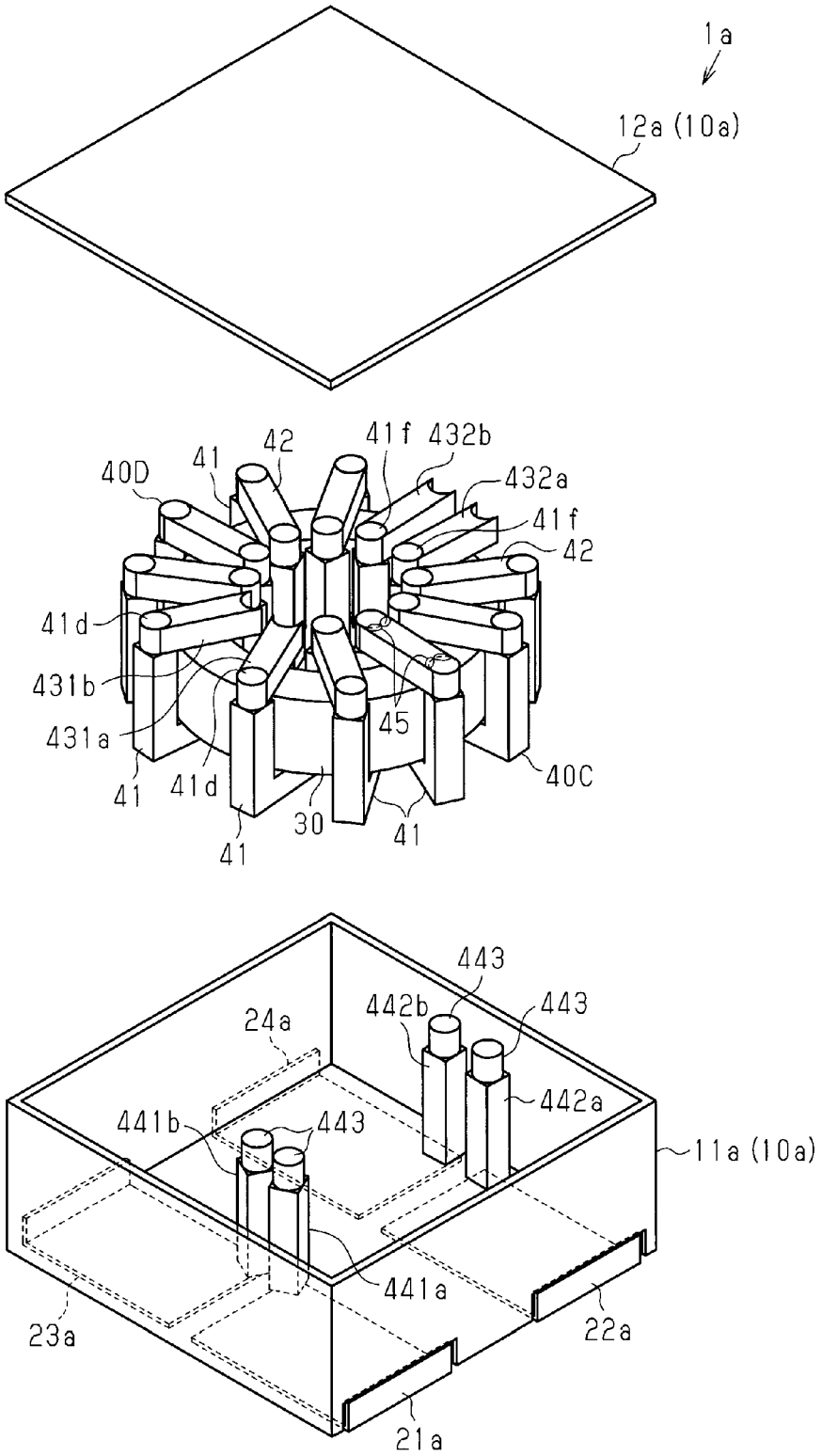
FIG. 13 is an exploded perspective view showing the second embodiment of the coil component.

As shown in FIG. 12 and FIG. 13, a coil component 1*a* includes the core 30, a first coil 40C, a second coil 40D, a rectangular parallelepiped case 10*a*, and first to fourth electrode terminals 21*a* to 24*a* attached to the case 10*a*. The case 10*a* has a box body 11*a* having an opening and a lid body 12*a* attached to the opening of the box body 11*a*. The case 10*a* is made of, for example, resin such as polyphenylene sulfide resin or ceramics. The first to fourth electrode terminals 21*a* to 24*a* are attached to the lower surface of a bottom portion 13*a* of the box body 11*a*.

Figure 14:
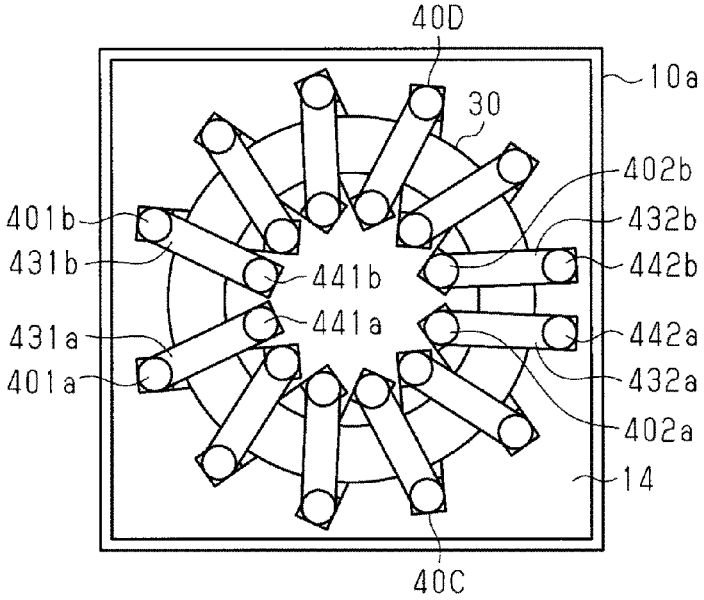
FIG. 14 is a plan view showing the second embodiment of the coil component.

As shown in FIGS. 13 and 14, the core 30, the first coil 40C, and the second coil 40D are accommodated in the case 10*a*. The first coil 40C and the second coil 40D are wound around the core 30. The first coil 40C includes the plurality of first wire members 41 and second wire members 42, two third wire members 431*a* and 432*a*, and two electrode wire members 441*a* and 442*a*. The second coil 40D includes the plurality of first wire members 41 and second wire members 42, two third wire members 431*b* and 432*b*, and two electrode wires 441*b* and 442*b*.

As shown in FIG. 13, the electrode wire members 441*a*, 442*a*, 441*b*, and 442*b* stand on the upper surface of the bottom portion 13 of the box body 11*a*. The electrode wire members 441*a*, 442*a*, 441*b*, and 442*b* are embedded in the bottom of the case 10*a* until positions where parts of lower end portions thereof respectively come into contact with the first to fourth electrode terminals 21*a*, 22*a*, 23*a*, and 24*a*. The electrode wire members 441*a*, 442*a*, 441*b*, and 442*b* are connected to the first to fourth electrode terminals 21*a*, 22*a*, 23*a*, and 24*a*, respectively, mechanically by crimping or the like or electrically by a joining material. Similarly to the first wire members 41, joining portions 443 are formed at the tips of the electrode wire members 441*a*, 442*a*, 441*b*, and 442*b*.

In the first coil 40C, the third wire member 431*a* is arranged between the first wire member 41 and the electrode wire member 441*a*. The respective end surfaces of the third wire member 431*a* are recessed cylindrical surfaces similar to those of the second wire members 42. One end surface of the third wire member 431*a* is joined to the first joining portion 41*d* of the first wire member 41 by welding, and the other end surface thereof is joined to the joining portion 443 of the electrode wire member 441*a* by welding. Similarly, the third wire member 432*a* is arranged between the first wire member 41 and the electrode wire member 442*a*. The third wire member 432*a* has the same shape as that of the third wire member 431*a*, and the end surfaces thereof are respectively joined to the second joining portion 41*f* of the first wire member 41 and the joining portion 443 of the electrode wire member 442*a* by welding.

The second coil 40D is configured similarly to the first coil 40C. The third wire member 431*b* is arranged between the first wire member 41 and the electrode wire member 441*b*. Similarly to the third wire member 431*a*, the respective end surfaces of the third wire member 431*b* are as recessed cylindrical surfaces. One end surface of the third wire member 431*b* is joined to the first joining portion 41*d* of the first wire member 41 by welding, and the other end surface thereof is joined to the joining portion 443 of the electrode wire member 441*b* by welding. Similarly, the third wire member 432*b* is arranged between the first wire member 41 and the electrode wire member 442*b*. The third wire member 432*b* has the same shape as that of the third wire member 431*b*, and the end surfaces thereof are respectively joined to the second joining portion 41*f* of the first wire member 41 and 443 of the electrode wire member 442*b* by welding.

The third wire members 431*a*, 432*a*, 431*b*, and 432*b* in states of being accommodated in the box body 11*a* are joined to the first wire members 41, and the electrode wire members 441*a*, 442*a*, 441*b*, and 442*b* by emitting the laser light from the same direction in the same way as the second wire members 42 in the welding step shown in FIG. 9, for example. In other words, the welding process of the third wire members 431*a*, 432*a*, 431*b*, and 432*b* and the other components can be performed continuously to the welding process of the second wire members 42 and the other components.

As described above, according to the embodiment, in addition to the same operational effects as those in the above-described first embodiment, the following operational effects can be obtained.

(2-1) A structure in which the first coil 40C and the second coil 40D are wound around the core 30 is accommodated in the box body 11, in this state, the first coil 40C and the electrode wire members 441*a* and 442*a* are joined together by welding and the second coil 40D and the electrode wire members 441*b* and 442*b* are joined together by welding, and the lid body 12 can be attached to the box body 11.

As described above, by attaching the electrode wire members 441*a*, 442*a*, 441*b*, and 442*b* to the structure in the state of being accommodated in the box body 11, it is possible to complete a main portion of the coil component 1 excluding the lid body 12. Therefore, in the welding process of the third wire members 431*a*, 432*a*, 431*b*, and 432*b* and other components and the welding process of the second wire members 42 and other components, it is not necessary to change the posture of the box body 11 and the like. Therefore, it is possible to reduce a time required for manufacturing and to simplify an apparatus for manufacturing, thereby reducing cost.

Third Embodiment

Hereinafter, a third embodiment will be described.

In this embodiment, the same constituent members as those in the above embodiments are denoted by the same reference signs, and description thereof will be omitted as appropriate. Further, description of relationships between the same constituent members will be also appropriately omitted.

Figure 15:
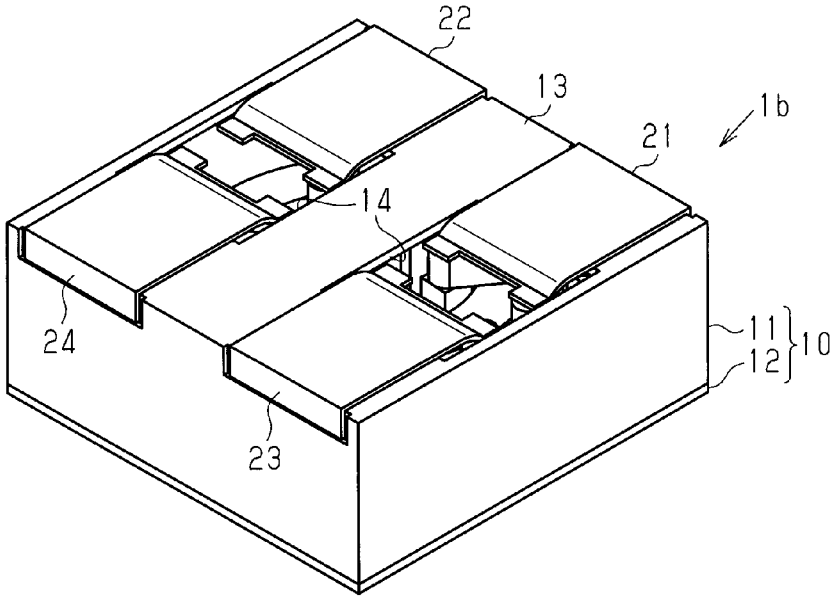
FIG. 15 is a perspective view showing a third embodiment of a coil component.
Figure 16:
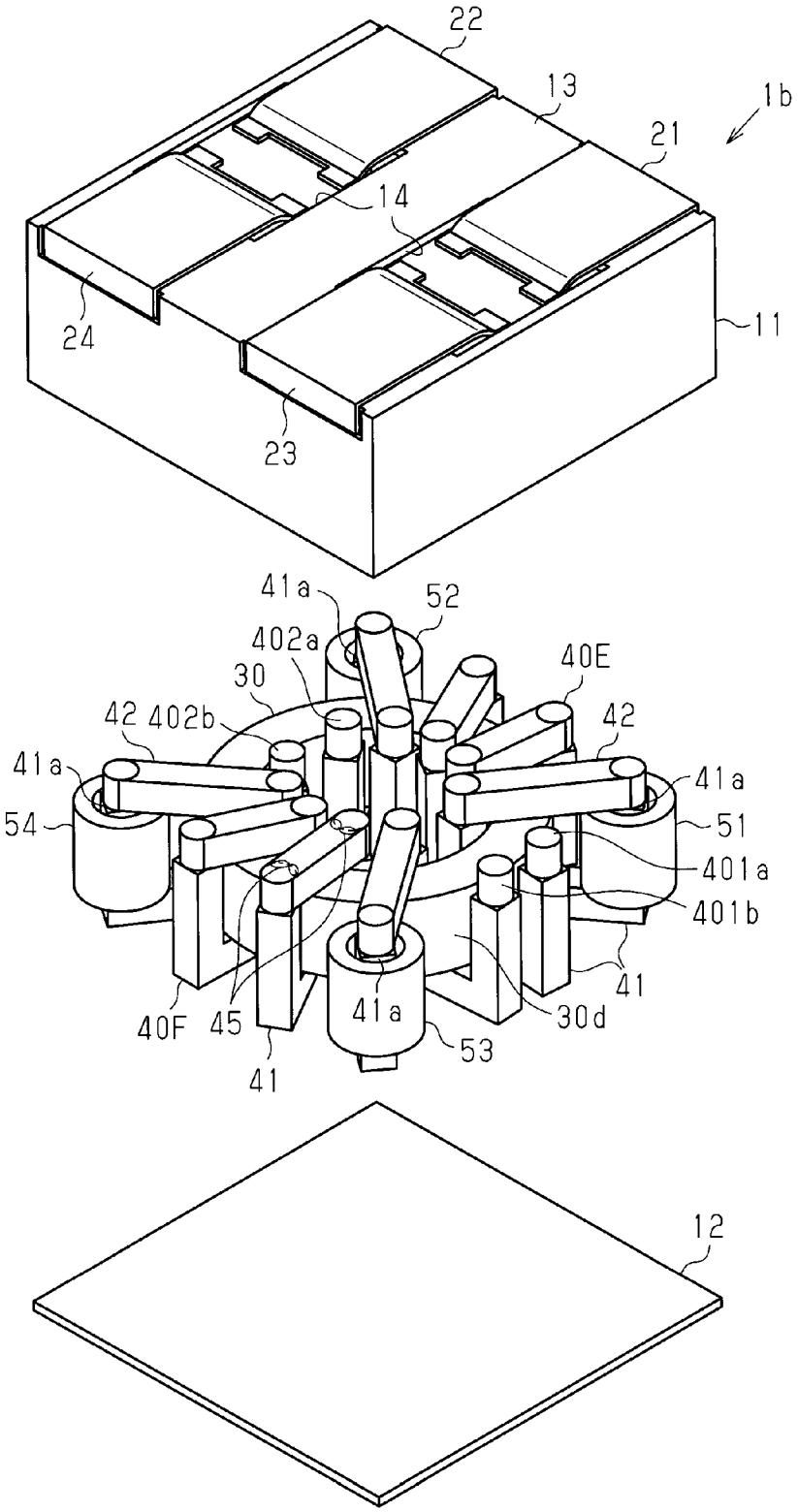
FIG. 16 is an exploded perspective view showing the third embodiment of the coil component.

As shown in FIG. 15 and FIG. 16, a coil component 1*b* includes the core 30, a first coil 40E, a second coil 40F, the case 10, and the first to fourth electrode terminals 21 to 24 attached to the case 10. Further, the coil component 1*b* includes first to fourth ferrite beads 51 to 54.

Figure 17:
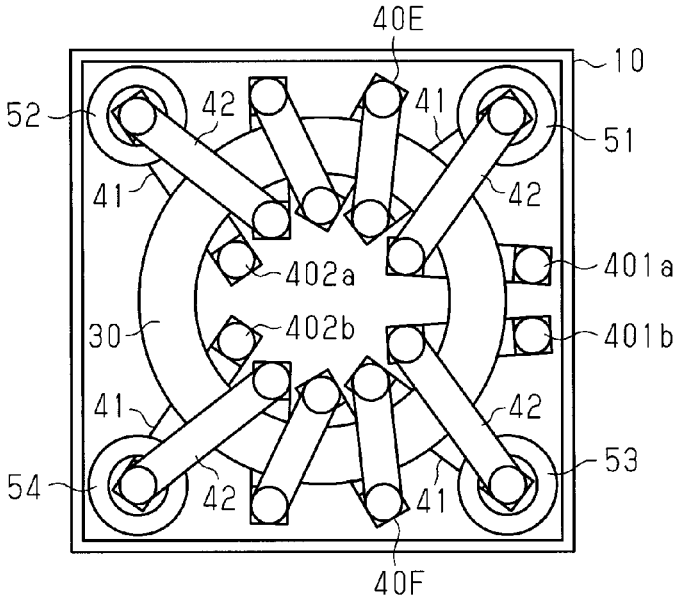
FIG. 17 is a plan view showing the third embodiment of the coil component.
Figure 18:
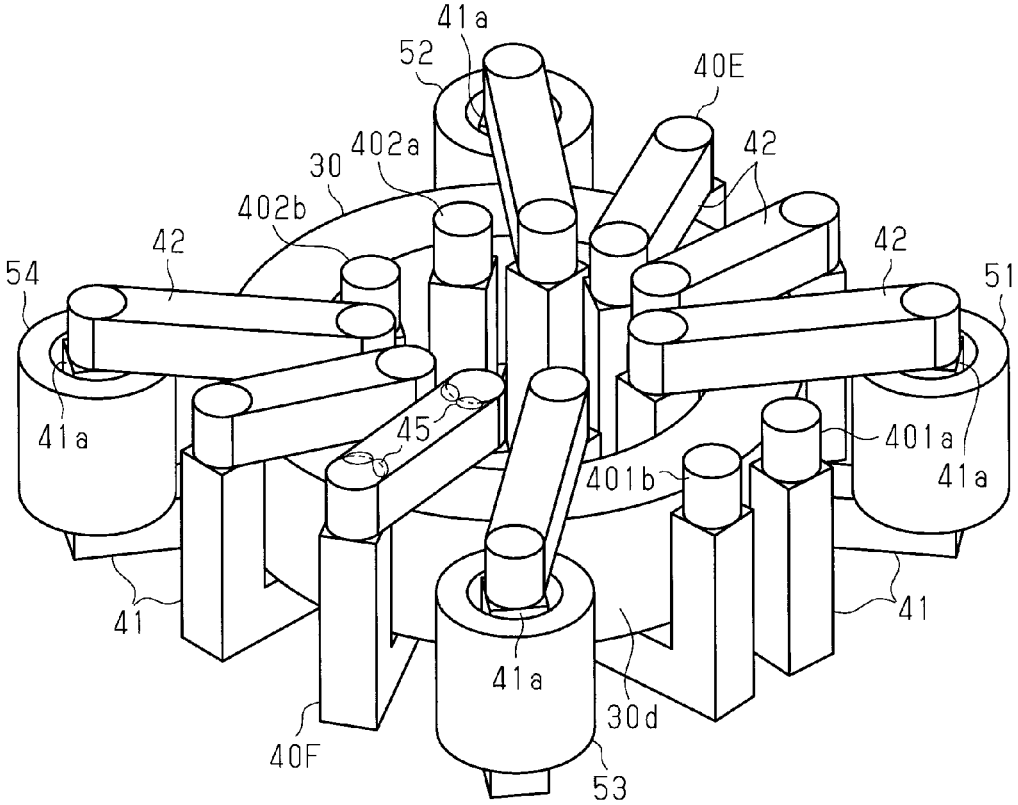
FIG. 18 is a perspective view showing a core and first and second members in the third embodiment.

As shown in FIGS. 16 and 17, the core 30, the first coil 40E, the second coil 40F, and the first to fourth ferrite beads 51 to 54 are accommodated in the case 10. As shown in FIGS. 16 and 18, the first coil 40E and the second coil 40F are wound around the core 30. The first coil 40E and the second coil 40F are composed of the plurality of first wire members 41 and the plurality of second wire members 42. The first and second ferrite beads 51 and 52 are attached to the first coil 40E and the third and fourth ferrite beads 53 and 54 are attached to the second coil 40F.

The first to fourth ferrite beads 51 to 54 are formed in cylindrical shapes. The first to fourth ferrite beads 51 to 54 are made of, for example, a magnetic material such as nickel-zinc (NiZn) or manganese-zinc (MnZn).

The first columnar portion 41*a* of one first wire member 41 constituting the first coil 40E is inserted into each of the first and second ferrite beads 51 and 52 of the first coil 40E. Similarly, the first columnar portion 41*a* of one first wire member 41 constituting the second coil 40F is inserted into each of the third and fourth ferrite beads 53 and 54 of the second coil 40F.

Each of the axial lines of the first to fourth ferrite beads 51 to 54 is parallel to the center axis of the core 30. The first to fourth ferrite beads 51 to 54 are located in the outer side portions in the radial direction of the core 30. Accordingly, the first to fourth ferrite beads 51 to 54 face the outer side surface 30*d* of the core 30. In addition, the first to fourth ferrite beads 51 to 54 are positioned at four corners of the case 10 in a state of being accommodated in the case 10.

The first ferrite bead 51 is located closer to the first end portion 401*a* in the first coil 40E. In other words, the first ferrite bead 51 is located at a position where the first coil 40E is wound substantially one turn from the first end portion 401*a*. The second ferrite bead 52 is located closer to the second end portion 402*a* in the first coil 40E. In other words, the second ferrite bead 52 is located at a position where the first coil 40E is wound substantially one turn from the second end portion 402*a*.

The third ferrite bead 53 is located closer to the first end portion 401*b* in the second coil 40F. In other words, the third ferrite bead 53 is located at a position where the second coil 40F is wound substantially one turn from the first end portion 401*b*. The fourth ferrite bead 54 is located closer to the second end portion 402*b* in the second coil 40F. In other words, the fourth ferrite bead 54 is located at a position where the second coil 40F is wound substantially one turn from the second end portion 402*b*.

The first to fourth ferrite beads 51 to 54 are arranged around the core 30 at the same time as, for example, arrangement of the wire members around the core 30. In the step shown in FIG. 7 in the above first embodiment, the core 30 is mounted. At this time, the first columnar portions 41*a* of the first wire members 41 are inserted into the first to fourth ferrite beads 51 to 54.

Next, noise removal of a normal mode component will be described. A normal mode current flows, for example, through the first coil 40E in the direction from the first end portion 401*a* toward the second end portion 402*a* and through the second coil 40F in the direction from the second end portion 402*b* toward the first end portion 401*b*. When the normal mode current flows through the first coil 40E, first magnetic flux is generated in the core 30 by the first coil 40E. When the normal mode current flows through the second coil 40F, second magnetic flux is generated in the core 30 in the direction opposite to the first magnetic flux.

Since the first magnetic flux and the second magnetic flux in the core 30 cancel each other, the first coil 40E and the core 30, and the second coil 40F and the core 30 do not act as an inductance component.

On the other hand, when the normal mode current flows through the first coil 40E, magnetic flux is generated by the first coil 40E in each of the first and second ferrite beads 51 and 52. When the normal mode current flows through the second coil 40F, magnetic flux is generated by the second coil 40F in each of the third and fourth ferrite beads 53 and 54. Therefore, the first coil 40E and the first and second ferrite beads 51 and 52 act as inductance components, and the second coil 40F and the third and fourth ferrite beads 53 and 54 act as inductance components, thereby removing noise of the normal mode component.

Next, noise removal of a common mode component will be described. A common mode current flows, for example, through the first coil 40E in the direction from the first end portion 401*a* toward the second end portion 402*a* and through the second coil 40F in the direction from the first end portion 401*b* toward the second end portion 402*b*. When the common mode current flows through the first coil 40E, first magnetic flux is generated in the core 30 by the first coil 40E. When the common mode current flows through the second coil 40F, second magnetic flux is generated in the core 30 in the same direction as the first magnetic flux. Therefore, the first coil 40E and the core 30, and the second coil 40F and the core 30 act as inductance components, and noise of the common mode component is removed.

As described above, according to the embodiment, in addition to the same operational effects as those of the above-described embodiments, the following operational effects can be obtained.

(3-1) Impedance of the normal mode can be increased while maintaining the impedance of the common mode. The material of the first to fourth ferrite beads 51 to 54 can be made different from that of the core 30. Therefore, the degree of freedom in setting of the impedance of the normal mode is increased.

(3-2) One first wire member 41 constituting the first coil 40E is inserted into each of the first and second ferrite beads 51 and 52 and one first wire member 41 constituting the second coil 40F is inserted into each of the third and fourth ferrite beads 53 and 54. Thus, the first to fourth ferrite beads 51 to 54 can be reduced in size, and the first to fourth ferrite beads 51 to 54 can be mounted at desired positions.

(3-3) The first to fourth ferrite beads 51 to 54 are located in the outer side portions in the radial direction of the core 30. Accordingly, the degree of freedom of arrangement of the first to fourth ferrite beads 51 to 54 on the core 30 is increased.

(3-4) The first to fourth ferrite beads 51 to 54 are located at the four corners of the case 10. Accordingly, the first to fourth ferrite beads 51 to 54 can be arranged in dead spaces of the case 10, and the dead spaces can be effectively utilized. As a result, it is possible to suppress increase in the size of the coil component 1*b* including the first to fourth ferrite beads 51 to 54.

Hereinafter, variations on the respective embodiments described above will be described. Note that in the description of the joint structure between the first wire members 41 and the second wire members 42, only the first joining portions 41*d* of the first and second joining portions 41*d* and 41*f* of the first wire members 41 are illustrated, but the same structure can be applied to the second joining portions 41*f*.

Figure 19A:
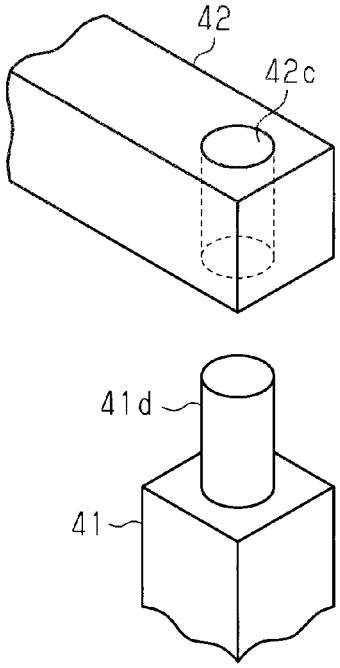
FIGS. 19A to 19D are partial perspective views of first and second members of another embodiment.

The shapes of the first wire members and the second wire members may be changed as appropriate. As shown in FIG. 19A, a through-hole 42*c* having a circular opening is formed in an end portion of each second wire member 42. An inner diameter of the through-hole 42*c* is slightly smaller than the outer diameter of the first joining portion 41*d* of each first wire member 41. The first joining portion 41*d* of the first wire member 41 is press-fitted into the through-hole 42*c*. In other words, the through-hole 42*c* and the first joining portion 41*d* are joined together using a tight fitting structure. In this case, the inner circumferential surface of the through-hole 42*c* is a joining surface which is fitted with the side surface of the first joining portion 41*d*. In addition, the diameter and the like of the through-hole 42*c* are set such that the area of the inner circumferential surface thereof is larger than the average cross-sectional area of each second wire members 42. Thus, by forming the tight fitting structure between the through-hole 42*c* and the first joining portion 41*d*, the inner circumferential surface of the through-hole 42*c* and the side surface of the first joining portion 41*d* can be reliably brought into contact with each other over the entire circumference. By employing such a tight fitting structure, since the side surface of the first joining portion 41*d* and the inner circumferential surface of the through-hole 42*c* are not separated from each other, it is hard for each second wire member 42 to fall off in the manufacturing process.

Note that in order to join the through-holes 42*c* and the first joining portions 41*d* at the tips of the first wire members 41, the above-described tight fitting structure may not be adopted and the first joining portions 41*d* at the tips of the first wire members 41 may be fitted into the through-holes 42*c* without any gap therebetween.

Further, the shapes of the side surfaces of the first joining portions 41*d* at the tips of the first wire members 41 and the shapes of the end surfaces 42*a* and 42*b* of the second wire members 42 may be appropriately changed as long as they can be welded to each other and the cross sections of the welding portions have areas equal to or larger than the average cross-sectional area. For example, the shapes may be changed such that parts thereof make surface contact with each other.

In the first to third embodiments, the tight fitting structure described above may be employed for joining the first wire members 41 and the second wire members 42. In this case, it is sufficient that the curvatures (curvatures of the cylindrical surfaces) of the side surfaces of the first joining portions 41*d* of the first wire members 41 are made slightly larger than the curvatures (curvatures of the recessed cylindrical surfaces) of the end surfaces 42*b* of the second wire members 42 and the side surfaces of the first joining portions 41*d* and the end surfaces 42*b* of the second wire members 42 are fitted with each other.

Figure 19B:
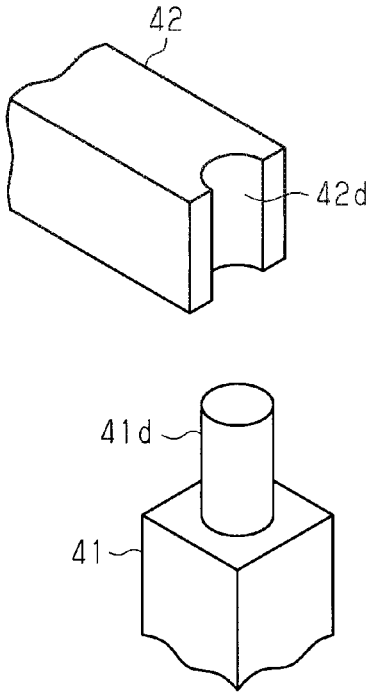

As shown in FIG. 19B, in the end portions of the second wire members 42, grooves 42*d* having, as inner surfaces, recessed cylindrical surfaces corresponding to the first joining portions 41*d* of the first wire members 41 are formed. The curvatures of the inner surfaces of the grooves 42*d* are equal to the curvatures of the side surfaces of the first joining portions 41*d* after fitting. The inner surfaces of the grooves 42*d* are joining surfaces which are fitted with the side surfaces of the first joining portion 41*d*. The curvatures and the like of the grooves 42*d* are set such that the areas of the inner surfaces thereof are larger than the average cross-sectional areas of the second wire members 42. In addition, the lengths of the inner surfaces (recessed cylindrical surfaces) of the grooves 42*d* in the circumferential direction are equal to the lengths of the half circumferences of the side surfaces (cylindrical surfaces) of the first joining portions 41*d*. Also in this configuration, it is possible to employ the above-described tight fitting structure.

In the first embodiment, the lengths of the end surfaces 42*b* (recessed cylindrical surfaces) of the second wire members 42 in the circumferential direction are made equal to the lengths of the half circumferences of the side surfaces (cylindrical surfaces) of the first joining portions 41*d*, but the lengths thereof in the circumferential direction may be shorter than the lengths of the half circumferences or may be longer than those in a range of equal to or shorter than the lengths of the whole circumferences. The same applies to the relationship between the inner surfaces of the grooves 42*d* and the side surfaces of the first joining portions 41*d* described in the above variation.

Figure 19C:
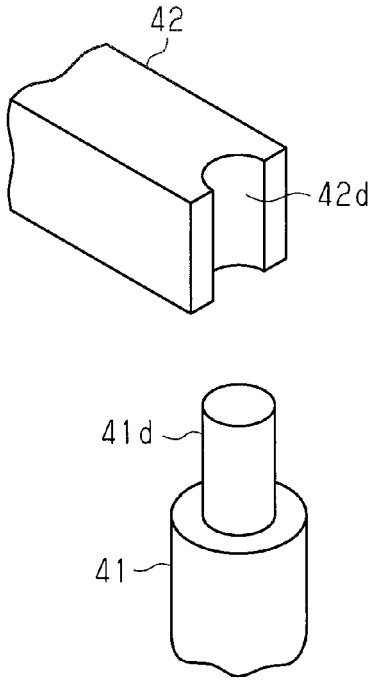

As shown in FIG. 19C, the first wire members 41 may be formed by a bar material (round material) having a circular cross section. The round material is easier to obtain and lower in cost than the square material. Accordingly, the cost of the coil component can be reduced.

Figure 19D:
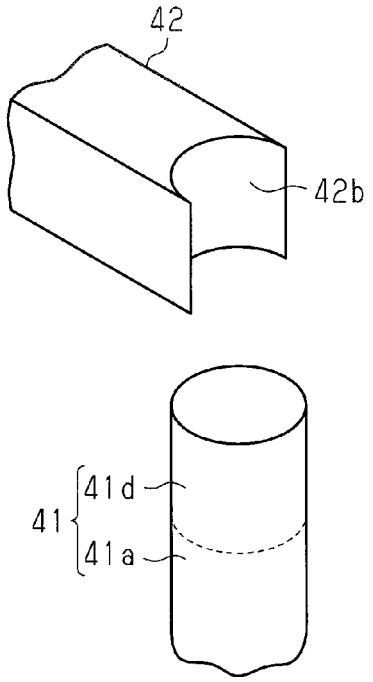

As shown in FIG. 19D, the first wire members 41 having circular cross sections may be used, and the outer dimensions (diameters) of the first joining portions 41*d* at the tips of the first wire members 41 may be made equal to the outer dimensions (diameters) of the first columnar portions 41*a*.

In addition, the cross-sectional shapes of the first wire members 41 and the second wire members 42 may be polygonal shapes other than the circular and square shapes. In the case where the second wire members 42 are formed by the bar material (round material) having the circular cross section, as in the case of the first wire members 41, the cost of the coil component can be reduced. Even if the cross-sectional shapes of the first wire members 41 and the second wire members 42 are not square, it is possible to obtain an operational effect similar to the operational effect (1-5) in the first embodiment as long as they are polygonal shapes.

The shape of the core 30 may be changed as appropriate. For example, it may be an annular shape such as a polygon, an ellipse, or an oval in plan view. In addition, the shape of the longitudinal cross section of the core 30 is not limited to a rectangular shape, and may be a polygonal shape other than the rectangular shape, a circular shape, or the like. In this case, it is preferable that the first wire members 41 and the second wire members 42 have shapes following the outer shape of the longitudinal cross section of the core 30.

The coil component may be formed by winding one coil around the core 30 or formed by winding equal to or more than three coils around the core 30. Although in each of the above embodiments, the first wire members 41 are formed by bending the bar material, the first wire members 41 may be formed by another method. For example, the first wire members 41 may be formed by pressing or cutting. Further, at least one of the first and second columnar portions 41*a* and 41*b* and the connecting portion 41*c* shown in FIG. 4B may be formed as a separate member, and these may be joined together by welding or the like to form each first wire member 41.

The joint parts of the coils, such as the joint parts between the first wire members 41 and the second wire members 42, can be joined by other welding methods than the laser beam welding described in each of the above embodiments, such as resistance welding and diffusion welding.

Even if the interfaces, which are easy to be generated in joining of different types of metals as described above, are generated in the joint parts, it is sufficient that the resistance loss of the coil component falls within an allowable value range, and for example, the first wire members 41 and the second wire members 42 may be joined together by solder. In this case, the welding portions are formed by the solder.

Although the first wire members 41 and the second wire members 42 are made of the same metal material, they can also be made of different metal materials. In this case, it is preferable that metals with a small difference in physical properties therebetween be selected. For example, when the laser beam welding is used for joining both of the wire members 41 and 42, it is preferable that metals with small differences in a thermal expansion coefficient, thermal conductivity, and melting temperature therebetween be selected, and when the resistance welding is used therefor, it is preferable that metals with small differences in resistivity in addition to the thermal expansion coefficient and the thermal conductivity therebetween be selected.

What is claimed is:

1. A coil component comprising:

an annular core; and a coil wound around the core, wherein:

the coil includes first wire members and second wire members;

the second wire members have joining surfaces in contact with side surfaces of joining portions at tips of the first wire members; and the first wire members and the second wire members are joined together with welding portions between the side surfaces of the joining portions and the joining surfaces interposed therebetween, wherein the joining portions have cylindrical shapes and the joining surfaces are recessed cylindrical surfaces which are provided in end portions of the second wire members and are fitted with the joining portions.

2. The coil component according to claim 1, wherein areas of the joining surfaces are larger than an average cross-sectional area of the second wire members.

3. The coil component according to claim 1, wherein the first wire members, the second wire members, and the welding portions are made of the same metal material.

4. The coil component according to claim 1, wherein the joining portions have cylindrical shapes, and the joining surfaces are inner circumferential surfaces of through-holes which are provided in the end portions of the second wire members and into which the joining portions are tightly fitted.

5. The coil component according to claim 1, wherein at least one of the first wire members and the second wire members have square cross sections.

6. The coil component according to claim 1, wherein at least one of the first wire members and the second wire members have circular cross sections.

7. The coil component according to claim 2, wherein the first wire members, the second wire members, and the welding portions are made of the same metal material.

* * * * *